US005819632A

United States Patent [19]

Moody

[11] Patent Number: 5,819,632

[45] Date of Patent: Oct. 13, 1998

[54] VARIABLE-SPEED ROTATING DRIVE

[75] Inventor: Paul E. Moody, Barrington, R.I.

[73] Assignee: The United States of America as represented by the Secretary of the Navy, Washington, D.C.

[21] Appl. No.: 640,580

[22] Filed: Apr. 28, 1996

[51] Int. Cl.[6] ..... F15B 11/02

[52] U.S. Cl. ..... 91/519; 92/31; 92/71

[58] Field of Search ..... 91/519; 92/31, 92/71, 136, 147

[56] References Cited

U.S. PATENT DOCUMENTS

| | | | |
|---|---|---|---|
| 2,942,523 | 6/1960 | Darsie | 92/136 |
| 2,970,442 | 2/1961 | Taylor | 92/31 |
| 3,513,754 | 5/1970 | John | 92/31 |
| 3,771,918 | 11/1973 | Winter | 92/136 |
| 3,818,801 | 6/1974 | Kime | 91/519 |
| 4,373,334 | 2/1983 | Carlander | 92/71 |

*Primary Examiner*—F. Daniel Lopez
*Attorney, Agent, or Firm*—Michael J. McGowan; James M. Kasischke; Prithvi C. Lall

[57] ABSTRACT

A variable-speed rotating drive is provided. A drive shaft terminates in a threaded piston that is received in an internally threaded cylinder. A plurality of linear actuators are distributed evenly about the circumferential periphery of the internally threaded cylinder. The drive shaft is mechanically coupled with each shaft of the linear actuators so that axial movement of the linear actuators' pistons causes the threaded piston to move axially in the internally threaded cylinder. This brings about axial rotation of the internally threaded cylinder. An actuating source is coupled to the linear actuators to cause the axial movement of selected ones of the pistons based upon the desired speed of rotation of the internally threaded cylinder.

15 Claims, 4 Drawing Sheets

HIGH PRESSURE SUPPLY
LOW PRESSURE SUPPLY
90
87
93
88
89
95
93
50
81
84
83
86
410
10
82
85
12
411
412
41
43
46
44
42
45
92
91
100

VARIABLE-SPEED ROTATING DRIVE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to drive systems, and more particularly to a variable-speed rotating drive suitable for driving the rotary pump of a torpedo ejection launch system.

(2) Description of the Prior Art

Currently, submarines utilize rotary pump ejection systems for the impulse launching of devices from submarine torpedo tubes. The state-of-the-art is the Navy's SS(N)21 rotary pump ejection system that couples a multi-stage air turbine to the pump's impeller. A controllable air firing valve operating on the submarine's air header controls the revolutions of the pump assembly by regulating the air valves' opening area according to a predetermined RPM schedule. While the performance of the SS(N)21 system has met all system requirements, its complexity and cost is recognized as excessive.

SUMMARY OF THE INVENTION

Accordingly, it is an object of the present invention to provide a variable-speed rotating drive system.

Another object of the present invention is to provide a linear drive system for coupling to a rotary pump.

Still another object of the present invention is to provide a linear drive system for operating with a submarine torpedo tube's rotary pump launch system.

Other objects and advantages of the present invention will become more obvious hereinafter in the specification and drawings.

In accordance with the present invention, a drive shaft terminates in a threaded piston that is received in an internally threaded cylinder. A plurality of linear actuators are distributed evenly about the circumferential periphery of the internally threaded cylinder. Each linear actuator includes a cylinder having a piston and a shaft coupled to the piston. The drive shaft is mechanically coupled with each shaft of the linear actuators. Axial movement of the pistons within the cylinders of the linear actuators causes the threaded piston to move axially in the internally threaded cylinder. This brings about axial rotation of the internally threaded cylinder. An actuating source is coupled to the linear actuators to cause the axial movement of selected pistons in order to control the rotational speed of the internally threaded cylinder.

BRIEF DESCRIPTION OF THE DRAWING(S)

Other objects, features and advantages of the present invention will become apparent upon reference to the following description of the preferred embodiments and to the drawings, wherein.

DESCRIPTION OF THE PREFERRED EMBODIMENT(S)

Figure 1:
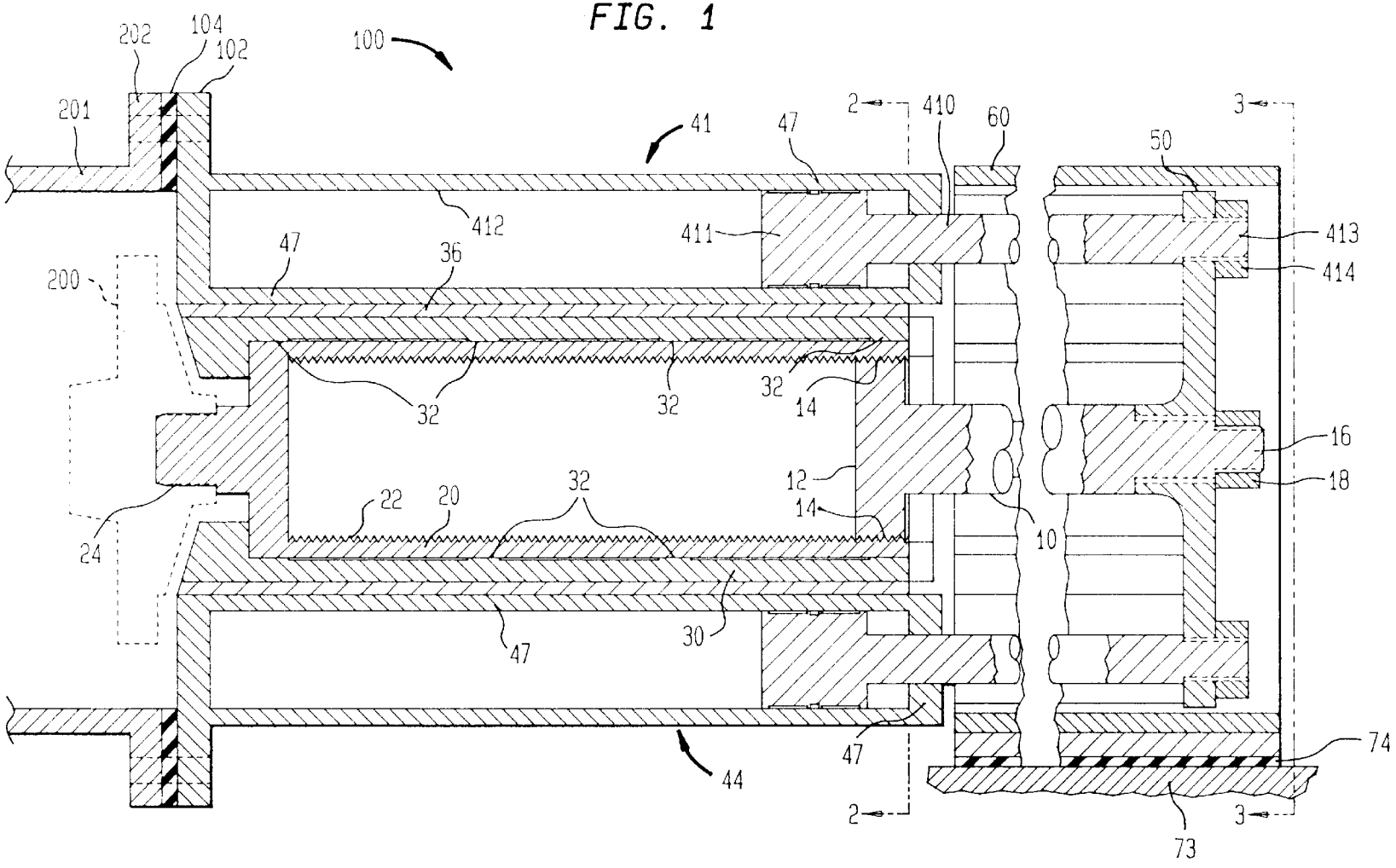
FIG. 1 is a cross-sectional view of the structural portion of the rotating drive of the present invention shown connected to the rotary pump of a submarine's launch system.

Referring now to the drawings, and more particularly to FIG. 1, a cross-sectional view of the rotating drive according to the present invention is shown and referenced generally by numeral 100. By way of example, rotating drive 100 is shown and will be explained with reference to its connection to rotational coupling 200 (shown in dashed-line phantom form) concentrically located within a mounting flange 201. Structurally, rotating drive 100 has a circumferential mounting flange 102 which is bolted to a similar circumferential flange 202 on mounting flange 201. Vibration isolation material, e.g, rubber, 104 can be provided between flanges 102 and 202. While the present invention will be described relative to this specific use, it is to be understood that the rotating drive of the present invention can be coupled to any other system relying on rotational drive.

Rotating drive 100 includes a centrally located drive shaft 10 that terminates on one end thereof in drive piston 12 having threads 14 formed along its outside circumferential wall. Piston 12 is threadably received within rotating cylinder 20. More specifically, cylinder 20 has threads 22 that cooperate with threads 14 of piston 12. Rotating cylinder 20 further has rotational coupling 24 extending axially therefrom for interlocking engagement with coupling 200 in order to translate axial rotation of cylinder 20 to coupling 200. Briefly, cylinder 20 undergoes axial rotation when drive piston 12 is moved axially along cylinder 20.

The mechanism for axially driving piston 12 will now be explained with continued reference to FIG. 1 and simultaneous reference to FIGS. 2 and 3 which depict cross-sectional views of rotating drive 100 taken along lines 2—2 and 3—3, respectively, of FIG. 1. Rotating cylinder 20 is supported in rotation by bearing housing 30 which contacts the outside circumference of rotating cylinder 20 at bearing areas 32. Each of bearing areas 32 represents bearings, e.g., ball or roller bearings, that minimize friction between the outside of cylinder 20 and bearing areas 32. Such bearings are well known in the art and will therefore not be discussed further herein.

A plurality of power cylinder assemblies 41–46 are distributed evenly about the circumferential periphery of rotating cylinder 20. Although six power cylinders are shown, only two such power cylinder assemblies are required to cause rotation of rotating cylinder 20, with additional ones or pairs of power cylinder assemblies being required to achieve variable-speed operation as will be explained further below. In terms of using an even number of power cylinder assemblies, the power cylinder assemblies comprising a pair of such assemblies are in diametric opposition with one another on either side of rotating cylinder 20. For example, power cylinder assemblies 41 and 44 are in diametric opposition and form one pair, power cylinder assemblies 42 and 45 form a second pair, and power cylinder assemblies 43 and 46 form a third pair. This arrangement will provide a balanced drive for piston 12.

Each power cylinder assembly includes a drive shaft coupled to a piston on one end thereof for movement within a cylinder. For the illustrated embodiment, it will be assumed that each of power cylinder assemblies is identical. Therefore, a more detailed description will only be provided for power cylinder assembly 41. As best seen in FIG. 1, power cylinder assembly 41 includes drive shaft 410 terminating at one end thereof at piston 411 which is slidingly received within cylinder 412. Free end 413 of drive shaft 410 is mechanically coupled to free end 16 of drive shaft 10 by means of axial drive coupling plate 50.

Plate 50 has legs 51–56 extending radially out from the center of plate 50. The center of plate 50 is fixed to free end 16 by nut 18. Legs 51–56 are similarly fixed to, or bolted with, the free ends of the drive shafts of the power cylinder assemblies. For example, free end 413 is fixed to leg 51 by means of nut 414. In similar fashion, legs 52–56 of plate 50 are fixed or bolted to each free end of the drive shafts associated with power cylinder assemblies 42–46.

Power cylinder assemblies are mechanically aligned and fixed as part of a rigid, e.g., metal, power cylinder framework 47 that is typically a unitary structure to define the cylinders of the assemblies. Since drive shaft 10 and the drive shafts of the power cylinder assemblies are coupled to one another via plate 50, it is necessary prevent the rotational tendencies of drive shaft 10 from being transferred to each drive shaft of the power cylinder assemblies. Accordingly, as best seen in FIG. 3, drive shaft framework 60 is separated from plate 50 by flat pieces (or strips) of bearing material 61–72 such as teflon, bronze, or special purpose bearing material. For example, bearing material 61 is positioned between plate 50 and framework 60 so that when leg 51 tends to rotate in a clockwise direction (due to the reaction force from cylinder 20 rotating around piston 12), bearing material 61 will prevent rotation with minimal drag or heat build-up. Similarly, bearing material strips 62–66 will prevent the clockwise rotation of legs 52–56, respectively. In this way, plate 50 is prevented from rotation throughout the entire stroke of the assembly. In a similar fashion, bearing material strips 67–72 prevent the rotation of plate 50 in a counterclockwise direction when the system is being returned to its at battery position. By simultaneously distributing the load over a plurality of bearing material strips, the load on each bearing strip is kept low. Framework 60 is supported on foundation 73. Vibration isolation material 74, e.g., rubber, can be provided between framework 60 and foundation 73.

Figure 2:
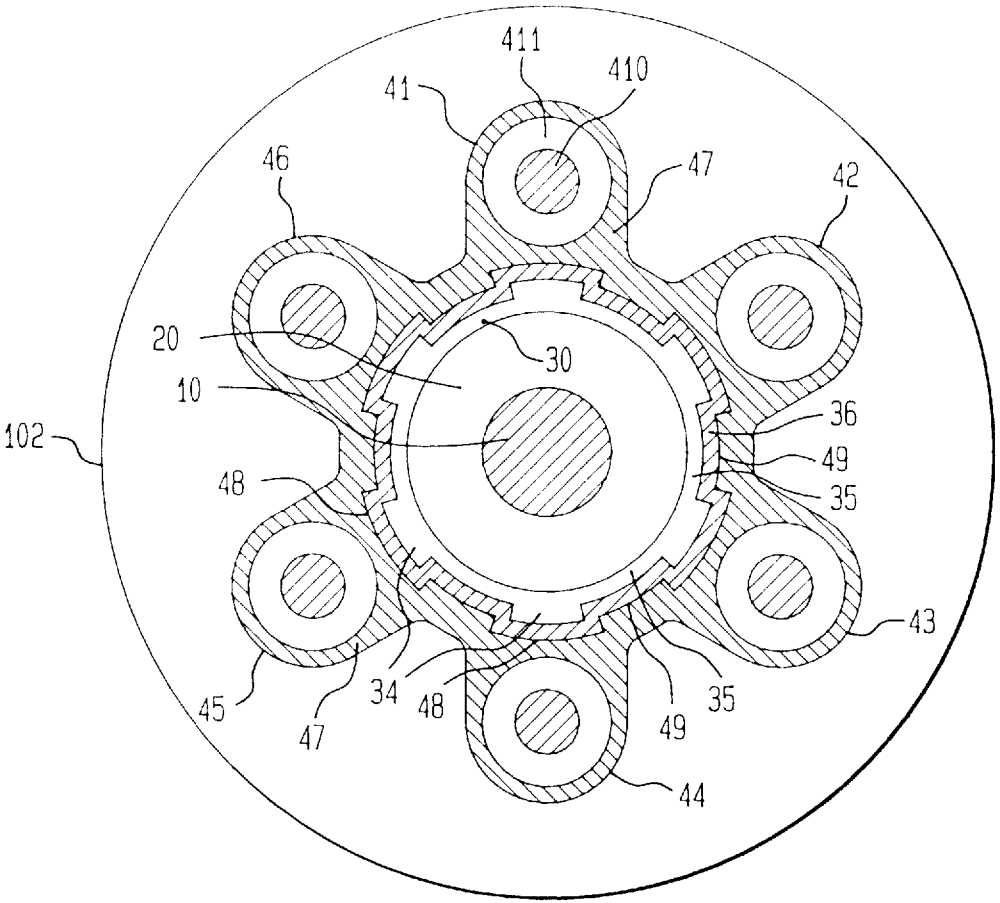
FIG. 2 is a cross-sectional view of the rotating drive taken along line 2—2 of FIG. 1.
Figure 3:
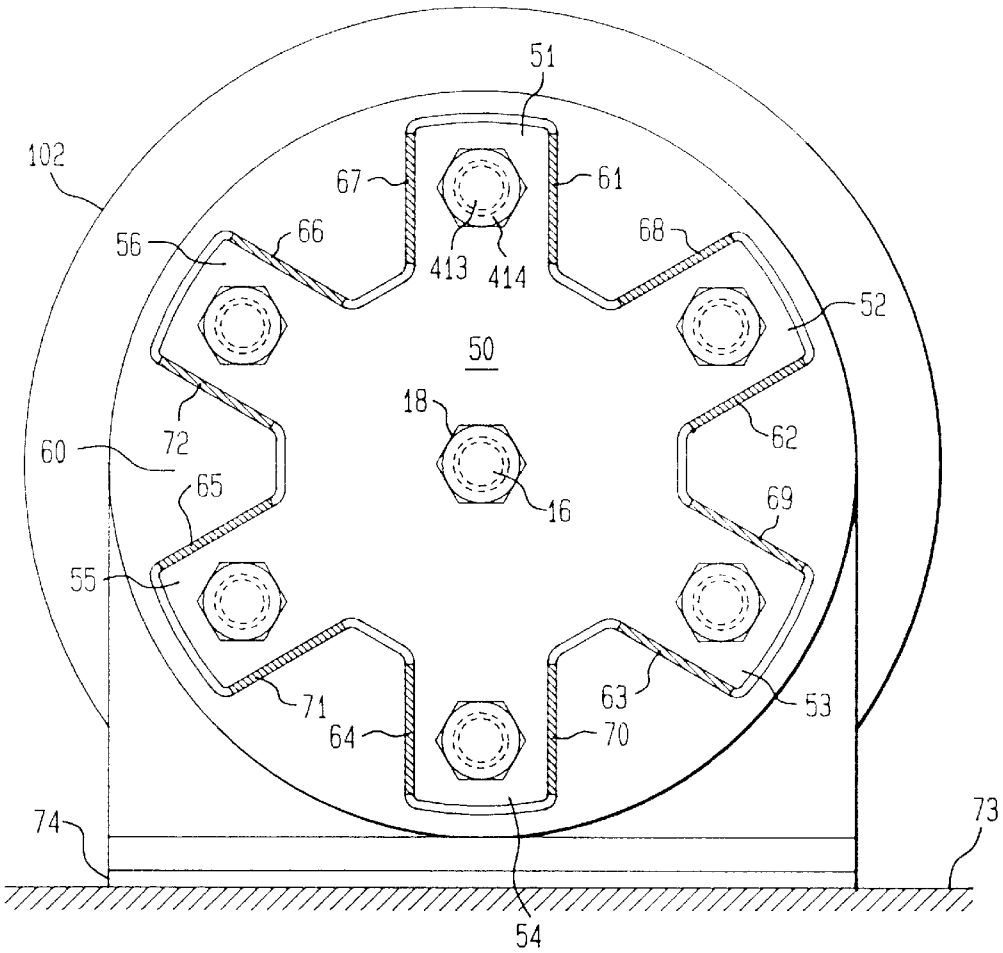
FIG. 3 is a cross-sectional view of the rotating drive taken along line 3—3 of FIG. 1.

Bearing housing 30, and thus rotating cylinder 20, are centrally positioned within framework 47 as best seen in FIG. 2. To prevent rotation of bearing housing 30 when rotating cylinder 20 is driven to rotate, the outside circumference of bearing housing 30 is splined to framework 47. More specifically, bearing housing 30 is provided with longitudinal splines 34 received in longitudinal channels 48 of framework 47. Similarly, framework 47 has longitudinal splines 49 received in longitudinal channels 35 of bearing housing 30. To minimize vibration, vibration absorbing material in the form of vibration isolation material 36 can be interposed or splined between the splines of framework 60 and bearing housing 30 as shown. Vibration isolation material 36 is normally an elastomeric compound.

Figure 4:
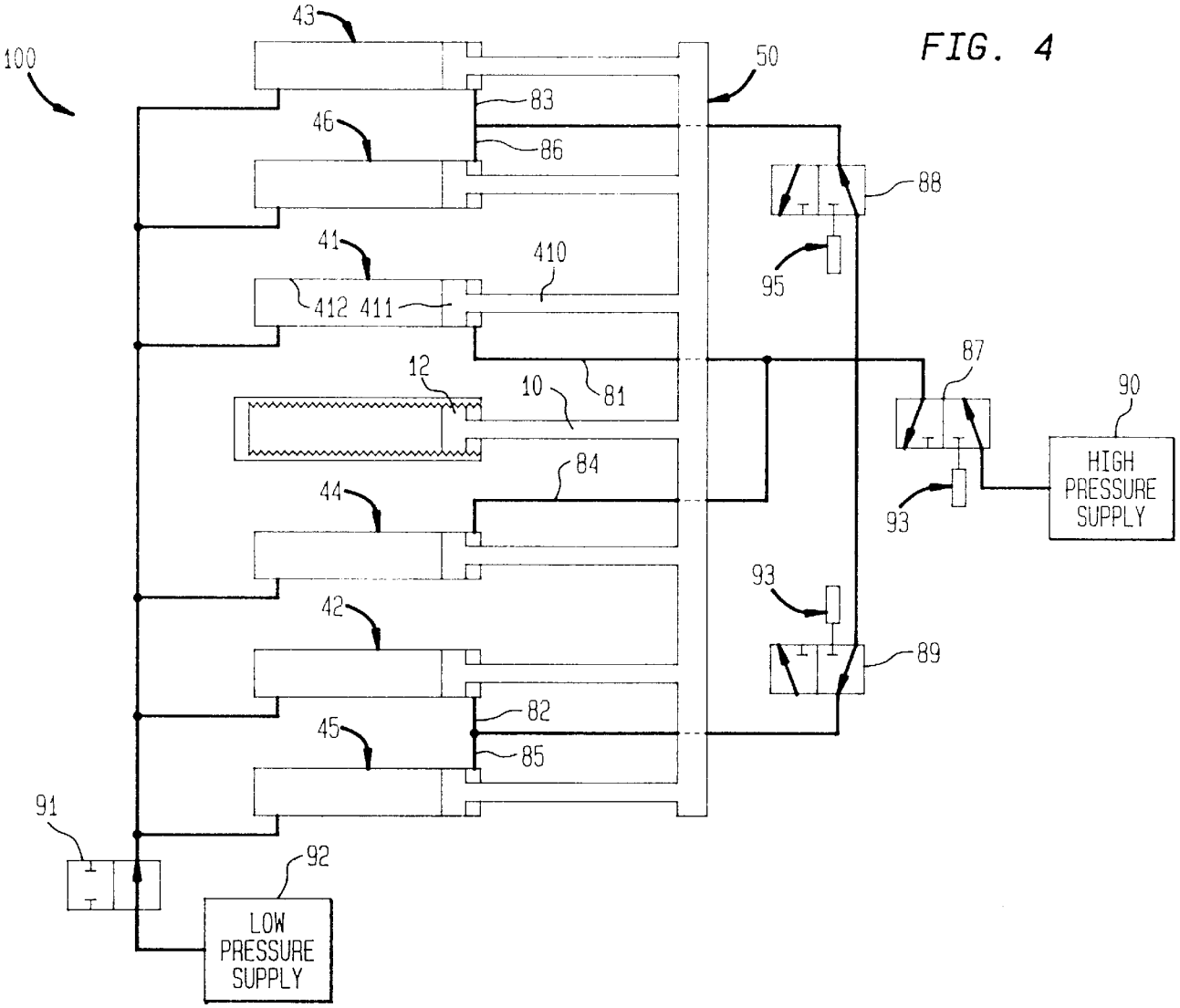
FIG. 4 is a schematic view of the rotating drive.

Power cylinder assemblies 41–46 are shown "at battery" in FIGS. 1 and 4. Each power cylinder assembly can be actuated by means of a pressurized motive liquid or gas supplied to the assembly's cylinder. For the remainder of the description, it will be assumed that pressurized air is to be used since a submarine typically has high-pressure (e.g., approximately 4500 psi) air readily available onboard. The high-pressure air supply is represented in FIG. 4 by high-pressure supply 90. Power cylinder assemblies 41 and 44 are supplied with pressurized air by lines 81 and 84, respectively; power cylinder assemblies 42 and 45 are supplied by lines 82 and 85, respectively; and power cylinder assemblies 43 and 46 are supplied by lines 83 and 86, respectively. Firing valve 87 and isolation valves 88 and 89 control which power cylinder assemblies receive the pressurized air. Essentially, the more power cylinders receiving the pressurized liquid or gas, the greater the force acting on piston 12 and the faster the rotation of rotating cylinder 20. Thus, the present invention achieves variable-speed rotation of rotating cylinder 20 by controlling how many of the power cylinder assemblies are actuated.

The operation of the present invention will be explained by way of example with reference to FIG. 4 where the position of valves 87, 88 and 89 reflect rotating drive 100 prior to actuation, i.e., firing valve 87 is isolating supply 90. Power cylinder assembly pair 41/44 will always receive high-pressure air when firing valve 87 is actuated to permit high-pressure air to flow therethrough from high-pressure supply 90. Isolation valves 88 and 89 are shown in position to supply high-pressure air to power cylinder assembly pair 43/46 and 42/45, respectively. Thus, rotating drive 100 is poised in FIG. 4 to maximize the force on drive shaft 10 and therefore maximize the rotational speed of rotating cylinder 20. If a reduced rotational speed were desired, then either or both of isolation valves 88 and 89 could be actuated to isolate either or both of power cylinder assembly pairs 43/46 and 42/45, respectively. In this way, rotating drive 100 can be operated at three speeds: low speed in which only pair 41/44 receives high-pressure air, medium speed in which pair 41/44 and one of either pairs 42/45 and 43/46 receive high-pressure air, and high speed in which all pairs receive high-pressure air. The power cylinder assemblies are actuated simultaneously on diametrically opposed pairs (e.g., pairs 41/44, 42/45 and 43/46) to maintain a balanced load on plate 50.

To prevent a build-up of pressure in the power cylinder assemblies, and to aid in the quiet deceleration portion of the assemblies' power stroke, low-pressure air can be supplied to the low-pressure side of each power cylinder assembly. This is depicted in FIG. 4 by return-to-battery valve 91 which is positioned to supply low-pressure air from low-pressure supply 92 to the low-pressure side of each power cylinder assembly. When return-to-battery valve 91 is actuated to its other position and valves 87, 88 and 89 are switched to their vent position, the power cylinder assemblies return to their at battery position. Vent mufflers 93 can be provided at each of valves 87, 88 and 89 to reduce the venting noise.

The advantages of the present invention are numerous. A variable-speed rotating drive is achieved with a minimum amount of system complexity thereby offering a lower cost solution to driving, for example, the rotary pump of a submarine's launch system. However, while the present invention has been described relative to a specific embodiment, it is not so limited. For example, the sizes of the power cylinder assemblies need not be identical as shown, but could be varied to provide additional rotating cylinder speed options. More or fewer power cylinders can be used. Pressurized hydraulics fluid could be used to actuate the system as opposed to pressurized air. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A variable-speed rotating drive for converting linear motion to rotational motion, comprising:

a drive shaft terminating in a threaded piston;

an internally threaded cylinder for receiving said threaded piston in a threaded engagement;

a plurality of linear actuators distributed evenly about a circumferential periphery of said internally threaded cylinder, each of said plurality of linear actuators including a cylinder having a piston and a shaft coupled to said piston, said shaft extending from said cylinder;

a device for mechanically coupling said drive shaft with each said shaft of said plurality of linear actuators; and an actuating source coupled to said plurality of linear actuators for causing axial movement of selected ones of said pistons to apply a balanced load to said device for mechanically coupling, wherein said axial movement of said selected ones of said pistons causes said threaded piston to move axially in said internally threaded cylinder to bring about axial rotation of said internally threaded cylinder.

2. A rotating drive as in claim 1 further comprising a housing supporting said axial rotation of said internally threaded cylinder.

3. A rotating drive as in claim 1 wherein said plurality of linear actuators comprises at least two pairs of linear actuators.

4. A rotating drive as in claim 3 wherein linear actuators associated with each said pair of linear actuators are located diametrically opposite one another with respect to said internally threaded cylinder.

5. A rotating drive as in claim 4 wherein said actuating source comprises:

a pressure supply supplying a high-pressure output; and a valved delivery system joined to said pressure supply and to said plurality of linear actuators for selectively supplying said high-pressure output to each said pair of linear actuators.

6. A variable-speed rotating drive for converting linear motion to rotational motion, comprising:

a drive shaft terminating in a threaded piston;

an internally threaded cylinder for receiving said threaded piston in a threaded engagement;

a bearing device supporting said internally threaded cylinder while allowing axial rotation of said internally threaded cylinder;

a plurality of linear actuators distributed evenly about a circumferential periphery of said internally threaded cylinder, each of said plurality of linear actuators including a cylinder having a piston and a shaft coupled to said piston, said shaft extending from said cylinder;

a device for mechanically coupling said drive shaft with each said shaft of said plurality of linear actuators; and an actuating source coupled to said plurality of linear actuators for causing axial movement of pistons associated with selected pairs of said plurality of linear actuators, each of said selected pairs being associated with diametrically opposed ones of said plurality of linear actuators with respect to said internally threaded cylinder such that said axial movement of said pistons associated with said selected pairs causes said threaded piston to be simultaneously driven axially in said internally threaded cylinder to bring about said axial rotation of said internally threaded cylinder.

7. A rotating drive as in claim 6 wherein said plurality of linear actuators comprises at least two pairs of linear actuators, wherein said axial rotation of said internally threaded cylinder is slowest when said selected pairs consists of one pair of said plurality of linear actuators, and wherein said axial rotation of said internally threaded cylinder is fastest when said selected pairs are all said plurality of linear actuators.

8. A variable-speed rotating drive for converting linear motion to rotational motion, comprising:

a drive shaft terminating in a threaded piston;

an internally threaded cylinder for receiving said threaded piston in a threaded engagement;

a bearing device encircling and supporting said internally threaded cylinder while allowing axial rotation of said internally threaded cylinder;

a plurality of linear actuators distributed evenly about a circumferential periphery of said internally threaded cylinder, each of said plurality of linear actuators including a cylinder having a piston and a shaft coupled to said piston, said shaft extending from said cylinder;

a material for absorbing vibration interposed between the exterior of said bearing device and said plurality of linear actuators;

a device for mechanically coupling said drive shaft with each said shaft of said plurality of linear actuators such that axial movement of said pistons within said cylinders of said plurality of linear actuators causes said threaded piston to be simultaneously driven axially in said internally threaded cylinder to bring about said axial rotation of said internally threaded cylinder; and an actuating source coupled to said plurality of linear actuators for causing said axial movement of said pistons associated with selected pairs of said plurality of linear actuators, each of said selected pairs being associated with diametrically opposed ones of said plurality of linear actuators with respect to said internally threaded cylinder.

9. A rotating drive as in claim 8 wherein said material is splined with said bearing device to impede axial rotation of said bearing device during said axial rotation of said internally threaded cylinder.

10. A variable-speed rotating drive for converting linear motion to rotational motion that is coupled to a rotary pump, comprising:

a drive shaft terminating in a threaded piston;

an internally threaded cylinder for receiving said threaded piston in a threaded engagement, said internally threaded cylinder terminating in an axially extending drive coupling for connection to said rotary pump;

a housing surrounding said internally threaded cylinder and having bearings axially supporting said internally threaded cylinder while allowing rotation of said internally threaded cylinder;

a plurality of linear actuators distributed evenly about a circumferential periphery of said internally threaded cylinder external to said housing, each of said plurality of linear actuators including a cylinder having a piston and a shaft coupled to said piston, said shaft extending from said cylinder;

a unitary framework for supporting said plurality of linear actuators;

a rigid plate mechanically coupling said drive shaft with each said shaft of said plurality of linear actuators; and an actuating source coupled to said plurality of linear actuators for causing axial movement of pistons associated with selected pairs of said plurality of linear actuators, each of said selected pairs being associated with diametrically opposed 2ones of said plurality of linear actuators with respect to said internally threaded cylinder such that said axial movement of said pistons associated with said selected pairs simultaneously causes said threaded piston to be driven axially in said internally threaded cylinder to bring about said axial rotation of said internally threaded cylinder.

11. A rotating drive as in claim 10 further comprising means for preventing rotation of said rigid plate as said threaded piston is driven axially in said internally threaded cylinder to bring about said axial rotation of said internally threaded cylinder.

12. A rotating drive as in claim 10 wherein said plurality of linear actuators comprises at least two pairs of linear actuators, wherein said axial rotation of said internally threaded cylinder is slowest when said selected pairs consists of one pair of said plurality of linear actuators, and wherein said axial rotation of said internally threaded cylinder is fastest when said selected pairs are all said plurality of linear actuators.

13. A rotating drive as in claim 10 wherein said actuating source comprises:

a pressure supply supplying a high-pressure output; and a valved delivery system joined to said pressure supply and to said plurality of linear actuators for selectively supplying said high-pressure output to said plurality of linear actuators.

14. A variable-speed rotating drive for converting linear motion to rotational motion that is coupled to a rotary pump, comprising:

a drive shaft terminating in a threaded piston;

an internally threaded cylinder for receiving said threaded piston in a threaded engagement, said internally threaded cylinder terminating in an axially extending drive coupling for connection to said rotary pump;

a housing surrounding said internally threaded cylinder and having bearings axially supporting said internally threaded cylinder while allowing rotation of said internally threaded cylinder;

a plurality of linear actuators distributed evenly about a circumferential periphery of said internally threaded cylinder external to said housing, each of said plurality of linear actuators including a cylinder having a piston and a shaft coupled to said piston, said shaft extending from said cylinder;

a unitary framework for supporting said plurality of linear actuators;

a material for absorbing vibration interposed between said housing and said frameworks;

a rigid plate mechanically coupling said drive shaft with each said shaft of said plurality of linear actuators such that axial movement of said pistons within said cylinders of said plurality of linear actuators simultaneously causes said threaded piston to be driven axially in said internally threaded cylinder to bring about said axial rotation of said internally threaded cylinder; and an actuating source coupled to said plurality of linear actuators for causing said axial movement of said pistons associated with selected pairs of said plurality of linear actuators, each of said selected pairs being associated with diametrically opposed ones of said plurality of linear actuators with respect to said internally threaded cylinder.

15. A rotating drive as in claim 14 wherein said material is splined with said housing and said framework to impede axial rotation of said housing during said axial rotation of said internally threaded cylinder.

* * * * *